US005676279A

United States Patent [19]

Bastion

[11] Patent Number: 5,676,279

[45] Date of Patent: Oct. 14, 1997

[54] GRAVITY POWERED TOOTHPASTE DISPENSING SYSTEM

[76] Inventor: Rafael Bastion, 612 Underhill Ave., Bronx, N.Y. 10473

[21] Appl. No.: 631,920

[22] Filed: Apr. 15, 1996

[51] Int. Cl.[6] ..... B65D 35/28

[52] U.S. Cl. ..... 222/93; 222/102; 222/181.3

[58] Field of Search ..... 222/93, 95, 96, 222/102, 105, 181.3, 183, 185, 505, 509, 517

[56] References Cited

U.S. PATENT DOCUMENTS

| | | | |
|---|---|---|---|
| 1,614,054 | 1/1927 | Wolkenhauer | 222/102 |
| 1,839,542 | 1/1932 | Ferguson | 222/93 |
| 1,841,275 | 1/1932 | Baptiste | 222/102 |
| 2,533,839 | 12/1950 | Robinson | 222/105 |
| 2,570,755 | 10/1951 | Booth | 222/15 |
| 3,233,784 | 2/1966 | Gordon | 222/102 |
| 4,548,337 | 10/1985 | Morris | 222/96 |

*Primary Examiner*—Philippe Derakshani

[57] ABSTRACT

A new Gravity Powered Toothpaste Dispensing System for dispensing of toothpaste with one action control without utilization of an additional power source and preventing unsanitary leakage from open toothpaste containers. The inventive device includes a housing structure, a toothpaste dispensing front cover attached to the housing structure, at least one roller member slidably positioned within the housing structure and descending upon a toothpaste tube for facilitating dispensing of toothpaste, and a toothpaste lever and cap.

7 Claims, 3 Drawing Sheets

GRAVITY POWERED TOOTHPASTE DISPENSING SYSTEM

BACKGROUND OF THE INVENTION

1. Field of the Invention

The present invention relates to Toothpaste Dispenser Devices and more particularly pertains to a new Gravity Powered Toothpaste Dispensing System for dispensing of toothpaste with one action control without utilization of an additional power source and preventing unsanitary leakage from open toothpaste containers.

2. Description of the Prior Art

The use of Toothpaste Dispenser Devices is known in the prior art. More specifically, Toothpaste Dispenser Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Toothpaste Dispenser Devices include U.S. Pat. No. 4,125,206; U.S. Pat. No. 5,199,610; U.S. Pat. Design No. 267,993; U.S. Pat. No. 4,844,301; U.S. Pat. No. 5,397,030 and U.S. Pat. No. 4,775,080.

While these devices fulfill their respective, particular objectives and requirements, the aforementioned patents do not disclose a new Gravity Powered Toothpaste Dispensing System. The inventive apparatus includes a housing structure, a toothpaste dispensing front cover attached to the housing structure, a toothpaste pressure means for facilitating dispensing of toothpaste, a fastener means, and a toothpaste lever and cap.

In these respects, the Gravity Powered Toothpaste Dispensing System according to the present invention substantially departs from the conventional concepts and designs of the prior art, and in so doing provides an apparatus primarily developed for the purpose of dispensing of toothpaste with one action control without utilization of an additional power source and preventing unsanitary leakage from open toothpaste containers.

SUMMARY OF THE INVENTION

In view of the foregoing disadvantages inherent in the known types of Toothpaste Dispenser Devices now present in the prior art, the present invention provides a new Gravity Powered Toothpaste Dispensing System construction wherein the same can be utilized for dispensing of toothpaste with one action control without utilization of an additional power source and preventing unsanitary leakage from open toothpaste containers. As such, the general purpose of the present invention, which will be described subsequently in greater detail, is to provide a new Gravity Powered Toothpaste Dispensing System apparatus and method which has many of the advantages of the Toothpaste Dispenser Devices mentioned heretofore and many novel features that result in a new Gravity Powered Toothpaste Dispensing System which is not anticipated, rendered obvious, suggested, or even implied by any of the prior art Toothpaste Dispenser Devices, either alone or in any combination thereof.

To attain this, the present invention generally comprises a housing structure, a toothpaste dispensing front cover attached to the housing structure, a toothpaste pressure means for facilitating dispensing of toothpaste, a fastener means, and a toothpaste lever and cap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Gravity Powered Toothpaste Dispensing System apparatus and method which has many of the advantages of the Toothpaste Dispenser Devices mentioned heretofore and many novel features that result in a new Gravity Powered Toothpaste Dispensing System which is not anticipated, rendered obvious, suggested, or even implied by any of the prior art Toothpaste Dispenser Devices, either alone or in any combination thereof.

It is another object of the present invention to provide a new Gravity Powered Toothpaste Dispensing System which may be easily and efficiently manufactured and marketed.

It is a further object of the present invention to provide a new Gravity Powered Toothpaste Dispensing System which is of a durable and reliable construction.

An even further object of the present invention is to provide a new Gravity Powered Toothpaste Dispensing System which is susceptible of a low cost of manufacture with regard to both materials and labor, and which accordingly is then susceptible of low prices of sale to the consuming public, thereby making such Gravity Powered Toothpaste Dispensing System economically available to the buying public.

Still yet another object of the present invention is to provide a new Gravity Powered Toothpaste Dispensing System which provides in the apparatuses and methods of the prior art some of the advantages thereof, while simultaneously overcoming some of the disadvantages normally associated therewith.

Still another object of the present invention is to provide a new Gravity Powered Toothpaste Dispensing System for dispensing of toothpaste with one action control without utilization of an additional power source and preventing unsanitary leakage from open toothpaste containers.

Yet another object of the present invention is to provide a new Gravity Powered Toothpaste Dispensing System which includes a housing structure, a toothpaste dispensing front cover attached to the housing structure, a toothpaste pressure means for facilitating dispensing of toothpaste, a fastener means, and a toothpaste lever and cap.

Even still another object of the present invention is to provide a new Gravity Powered Toothpaste Dispensing System wherein the user is able to facilitate the dispensing of toothpaste with only a single action of inserting the toothbrush into the present invention engaging a pivotally mounted toothpaste release lever which allows toothpaste to flow directly onto the inserted toothbrush from the pressure created in the toothpaste tube from a gravity powered toothpaste pressure means and where upon retraction of said toothbrush a toothpaste cap member prevents further dispensing of the toothpaste and allows long term storage of the toothpaste.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
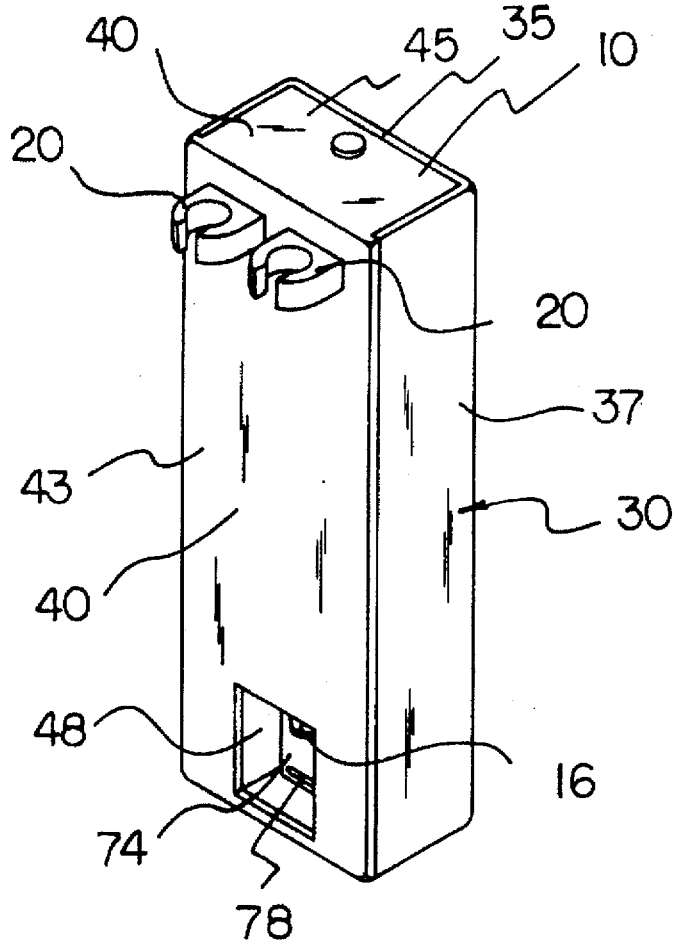
FIG. 1 is a right perspective view of a new Gravity Powered Toothpaste Dispensing System according to the present invention.
Figure 2:
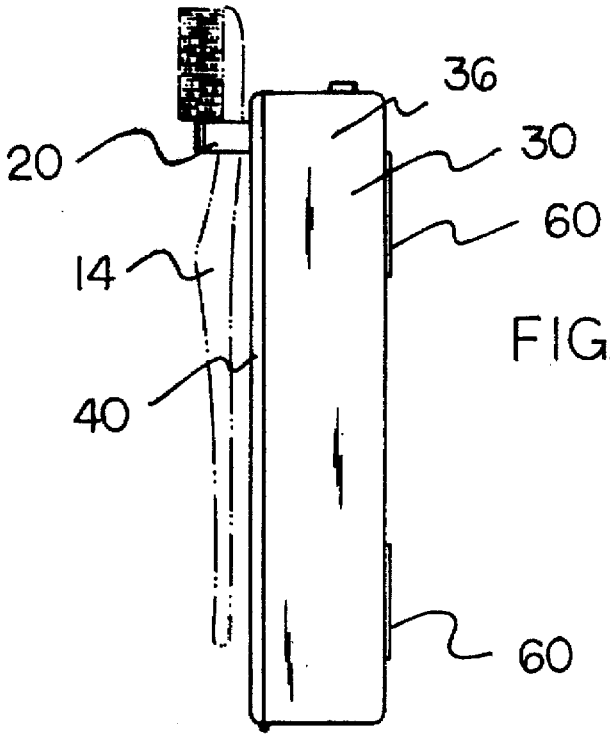
FIG. 2 is a right side view thereof.
Figure 3:
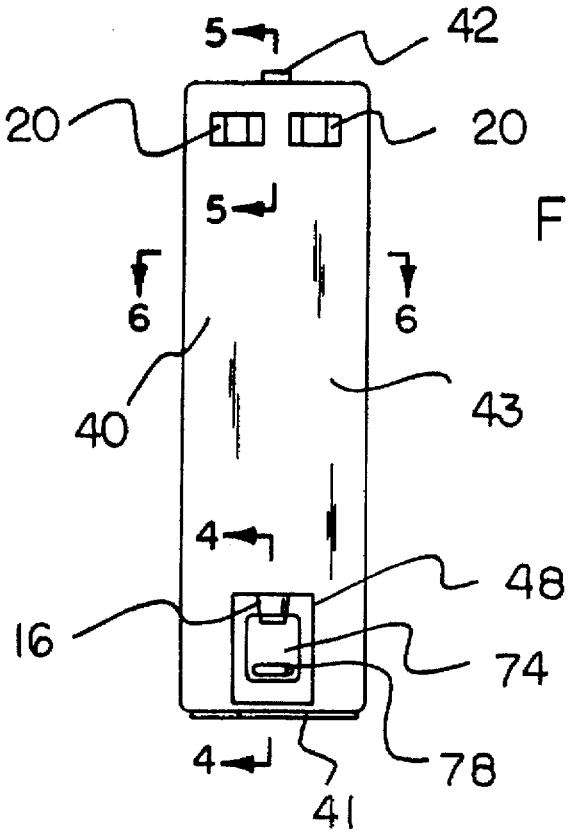
FIG. 3 is a front view of the present invention.
Figure 4:
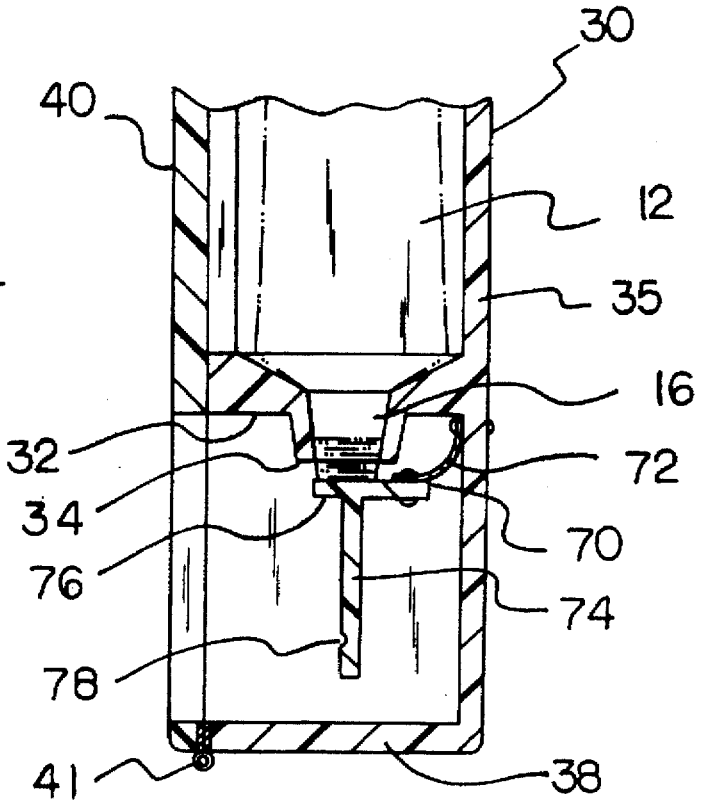
FIG. 4 is a cross sectional view taken along line 4—4 of FIG. 3.
Figure 5:
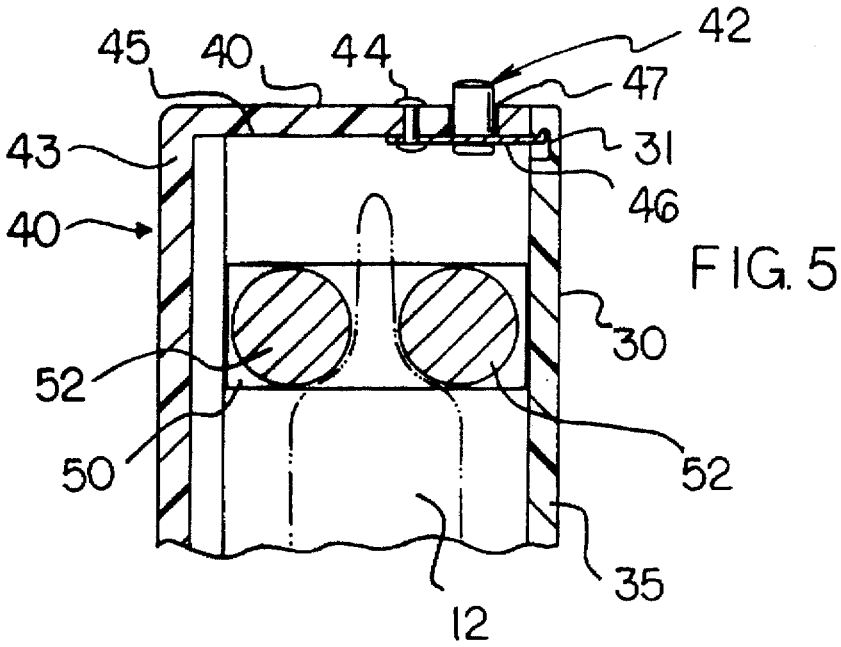
FIG. 5 is a cross sectional view taken along line 5—5 of FIG. 3.
Figure 6:
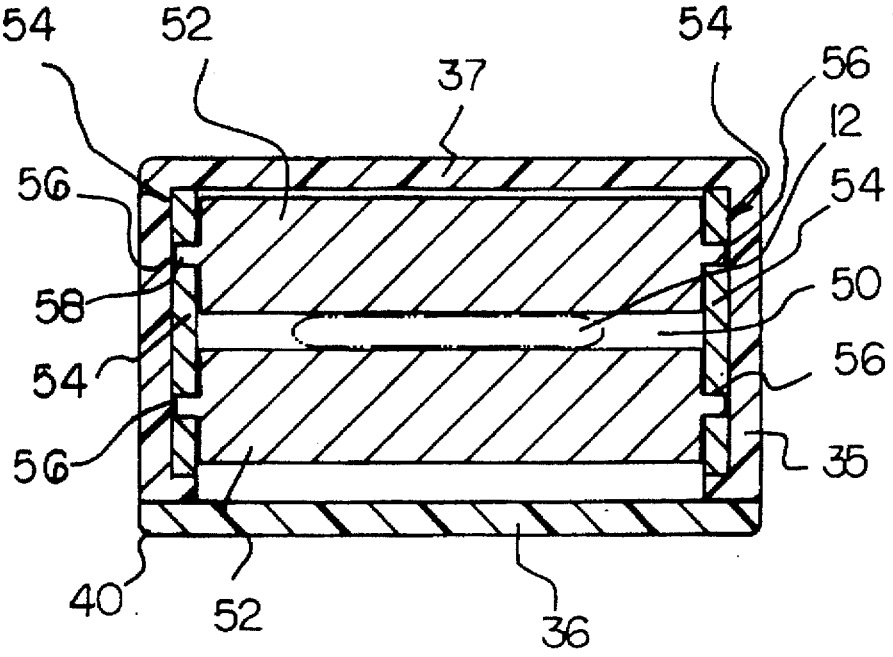
FIG. 6 is a cross sectional view taken along line 6—6 of FIG. 3.

With reference now to the drawings, and in particular to FIGS. 1–6 thereof, a new Gravity Powered Toothpaste Dispensing System embodying the principles and concepts of the present invention and generally designated by the reference numeral 10 will be described.

More specifically, it will be noted that the Gravity Powered Toothpaste Dispensing System 10 comprises a housing structure 30, a toothpaste dispensing front cover 40 attached to the housing structure 30, a toothpaste pressure means 50 positioned interiorly of the housing structure 30, a fastener means 60 for mounting the housing structure 30 to a wall, and a toothpaste lever and cap 70 mounted to the housing structure 30 allowing manual manipulation of the present invention.

As best illustrated in FIGS. 1 through 6, it can be shown that the housing structure 30 comprises a rear wall member 35 with a latch notch 31 in the interior upper portion of the rear wall member 35. A right side wall member 36 is attached orthogonally to the rear wall member 35. A left side wall member 37 is attached opposite of the right side wall member 36 orthogonally to the rear wall member 35 forming an unnumbered U-shaped structure. A bottom wall member 38 is secured horizontally to an end of the unnumbered U-shaped structure. A toothpaste tube support member 32 is mounted horizontally to the lower portion of the interior wall of the rear wall member 35 supporting a toothpaste tube 12 during operation of the present invention. The toothpaste tube support member 32 comprises a toothpaste nozzle aperture 34 to allow the insertion of a toothpaste tube nozzle 16. The toothpaste dispensing front cover 40 includes a front cover member 43 formed to fit the elongated passage of the housing structure 30 with one end of the front cover member 43 pivotally mounted to the bottom wall member 38 by a front cover hinge member 41. The toothpaste dispensing front cover 40 further comprises a top cover member 45 formed to cover the top open end of the housing structure 30 secured orthogonally to the front cover member 43 opposite of the front cover hinge member 41 completely enclosing the toothpaste tube 12. A toothbrush passage 48 in the lower portion of the front cover member 43 allows insertion of a toothbrush 14 for manual manipulation of the present invention. A cover latch 46 projects into the latch notch 31 securing the toothpaste dispensing front cover 40 from opening accidentally during operation of the present invention. A cover latch fastener 44 secures the cover latch 46 to the bottom side of the top cover member 45 near the end opposite of the front cover member 43. A cover latch button aperture 47 is located near the end opposite of the front cover member 43. A cover latch button 42 projects downwardly through the cover latch button aperture 47 engaging the cover latch 46 allowing manual manipulation of the cover latch 46 respective to the top cover member 45. At least one tooth brush holder 20 is mounted to the outer side of the upper portion of the front cover member 43 securing at least one toothbrush 14 during nonuse of the present invention. At least one roller side support plate 54 formed to fit interiorly adjacent to the right side wall member 36 is positioned interiorly of the housing structure 30 adjacent to a side wall. At least one roller support aperture 56 is included in the roller side support plate 54. At least one circular roller member 52 substantially the horizontal length of the front cover member 43 is attached to the roller side support plate 54 by an axle member 58 secured to one end of the circular roller member 52 projecting through the roller support aperture 56 indexing the circular roller member 52 during operation of the present invention. The toothpaste lever and cap 70 comprises a leaf spring member 72 with one end mounted to a lower portion of the rear wall member 35 below the toothpaste tube support member 32. A toothpaste cap member 76 is secured to the leaf spring member 72 opposite of the rear wall member 35 to prevent leakage of toothpaste during nonuse of the present invention. A toothpaste release lever 74 is secured orthogonally to the toothpaste cap member 76 near the end opposite of the leaf spring member 72 allowing manual manipulation of the toothpaste lever and cap 70 with the toothbrush 14. A horizontal indexing notch 78 projects into the lower portion of the toothpaste release lever 74 indexing the position of the toothbrush 14 during operation of the present invention. The fastener means 60 comprises at least one adhesive strip for mounting the present invention to an existing wall.

In use, the user simply inserts the toothbrush 14 through the toothbrush passage 48 engaging the toothpaste release lever 74 which pivots the toothpaste cap member 76 so as to allow the accumulated pressure in the toothpaste tube 12 forcing the toothpaste out through the toothpaste tube nozzle 16 onto the toothbrush 14. The toothpaste pressure means 50 transcends downward by the force of gravity acting upon the mass of the pressure means 50, n namely, th eassembly of the roller members 52 and the roller side support member 54 on the toothpaste tube 12 as the toothpaste is dispensed. When the user determines the correct amount of toothpaste has been dispensed, he or she simply pulls the toothbrush 14 from the present invention which allows the leaf spring member 72 to manipulate the toothpaste cap member 76 back to engagement with the toothpaste tube nozzle 16 to prevent further dispensing of the toothpaste.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Gravity Powered Toothpaste Dispensing System for use with a toothpaste tube having a nozzle, comprising:

an elongate housing structure having a substantially hollow interior for receiving a toothpaste tube and including a toothpaste dispensing front cover;

a toothpaste pressure means positioned interiorly of the housing structure;

wherein the housing structure comprises:

a rear wall member with a latch notch in the interior upper portion of the rear wall member;

a right side wall member attached orthogonally to the rear wall member;

a left side wall member attached opposite of the right side wall member orthogonally to the rear wall member, thereby defining an elongated passage;

a rear wall member with a latch notch in the interior upper portion of the rear wall member;

a bottom wall member secured in a horizontal position to an end of the rear wall member, a corresponding end of the right side wall member, and a corresponding end of the left side wall member, and a toothpaste tube support member above said bottom wall member and being adapted to support a toothpaste tube in a stationary position in said interior with the nozzle of said toothpaste tube pointed downwardly;

wherein the toothpaste dispensing front cover. further comprises a top cover member for covering an open end of the housing structure, said top cover member being secured orthogonally to the front cover member opposite of the front cover hinge member;

wherein the toothpaste dispensing front cover further comprises:

a toothbrush passage in the lower portion of the front cover member allowing insertion of a toothbrush;

a cover latch projecting into the latch notch securing the toothpaste dispensing front cover;

a cover latch fastener mounting the cover latch to the bottom side of the top cover member near the end opposite of the front cover member;

a cover latch button aperture substantially near the end opposite of the front cover member;

a cover latch button projecting downwardly through the cover latch button aperture engaging the cover latch allowing manual manipulation of the cover latch respective to the top cover member; and wherein the toothpaste pressure means comprises a roller assembly slidably received in the hollow interior of said housing structure in a manner permitting said roller assembly to move freely in an upward and downward direction between said top cover member and said toothpaste tube support, said roller assembly including:

a pair of spaced roller side support plates each having a pair of roller support apertures, each said support plate being positioned adjacent to the interior surface of a said side wall member in a manner permitting said side support plate to freely slide along said side wall member, a pair of elongate roller members, each said roller member having opposed ends with each end being mounted on a said side support plate in a manner permitting free rotation of said roller member, said roller members being mounted in a substantially parallel relationship with a gap therebetween to permit a toothpaste tube supported by said support plate to be inserted into said gap, wherein said roller assembly is freely moveable downwardly in said interior by gravity acting upon the mass of said roller assembly such that a toothpaste tube inserted in said gap is the only structure preventing said roller assembly from moving downwardly to said toothpaste tube support member to thereby permit the roller members of said roller assembly to compress said toothpaste tube when toothpaste is permitted to flow through the nozzle of said toothpaste tube.

2. The Gravity Powered Toothpaste Dispensing System of claim 1, wherein the roller members are cylindrical with a circular cross-sectional shape.

3. The Gravity Powered Toothpaste Dispensing System of claim 2, wherein:

the toothpaste lever and cap comprises a leaf spring member with one end mounted to a lower portion of the rear wall member below the toothpaste tube support member; and the toothpaste tube support member comprises a toothpaste nozzle aperture to allow the insertion of a toothpaste tube nozzle.

4. The Gravity Powered Toothpaste Dispensing System of claim 3, wherein the toothpaste lever and cap further comprises a toothpaste cap member mounted to the leaf spring member opposite of the rear wall member preventing leakage of toothpaste.

5. The Gravity Powered Toothpaste Dispensing System of claim 4, wherein the toothpaste lever and cap further comprises a toothpaste release lever secured orthogonally to the toothpaste cap member near the end opposite of the leaf spring member allowing manual manipulation of the toothpaste lever and cap with the toothbrush.

6. The Gravity Powered Toothpaste Dispensing System of claim 5, wherein the toothpaste release lever comprises a horizontal indexing notch in the lower portion of the toothpaste release lever indexing the position of the toothbrush during operation.

7. The Gravity Powered Toothpaste Dispensing System of claim 1, additionally comprising a fastener means comprising at least one adhesive strip for mounting the housing structure to a wall.

* * * * *